US006672518B1

(12) United States Patent
Mudge

(10) Patent No.: US 6,672,518 B1
(45) Date of Patent: Jan. 6, 2004

(54) SPINNING DISC RESIN ATOMIZER

(76) Inventor: Ronald D. Mudge, 22025 500th St., Bemidji, MN (US) 56601

( * ) Notice: Subject to any disclaimer, the term of this patent is extended or adjusted under 35 U.S.C. 154(b) by 0 days.

(21) Appl. No.: 10/171,096

(22) Filed: Jun. 12, 2002

(51) Int. Cl.[7] ..... B05B 3/00; B05B 3/02; B05B 1/14

(52) U.S. Cl. ..... 239/225.1; 239/222.11; 239/550

(58) Field of Search ..... 239/263.1, 222.11, 239/222.15, 223, 225.1, 224, 548, 550, 551, 565, 566; 118/300, 308; 427/242, 421

(56) References Cited

U.S. PATENT DOCUMENTS

| | | | | |
|---|---|---|---|---|
| 4,478,368 A | | 10/1984 | Yie | 239/430 |
| 4,824,026 A | | 4/1989 | Tamura et al. | 239/707 |
| 5,045,154 A | | 9/1991 | Baluha | 162/353 |
| 5,078,321 A | * | 1/1992 | Davis et al. | 239/224 |
| 5,616,290 A | | 4/1997 | Ishihara et al. | 261/115 |
| 5,618,177 A | | 4/1997 | Abbott | 433/88 |
| 5,704,554 A | | 1/1998 | Cooper et al. | 239/690 |
| 5,722,591 A | | 3/1998 | Folger | 239/171 |
| 5,914,153 A | * | 6/1999 | Swink et al. | 427/242 |

* cited by examiner

*Primary Examiner*—Michael J. Hayes
*Assistant Examiner*—Lina R Kontos
(74) *Attorney, Agent, or Firm*—Curtis Harr

(57) ABSTRACT

A resin atomizer unit is provided that is constructed from a variety of ultra high molecular weight (UHMW) plastics. The use of these materials benefits in the construction of a resin atomizer by reducing the resin's tendency to adhere to the critical surfaces during operation. These materials also have the beneficial quality of resisting the abrasive nature of the resin. Another benefit of the use of the materials herein described in the construction of the present invention is that they also lessen its overall weight which makes any maintenance that may be required much easier. Finally, the quick release method of attaching the individual resin atomizers also enhances the ease by which they can be serviced and thereby leads to greater efficiencies in their use.

17 Claims, 6 Drawing Sheets

FIG 1
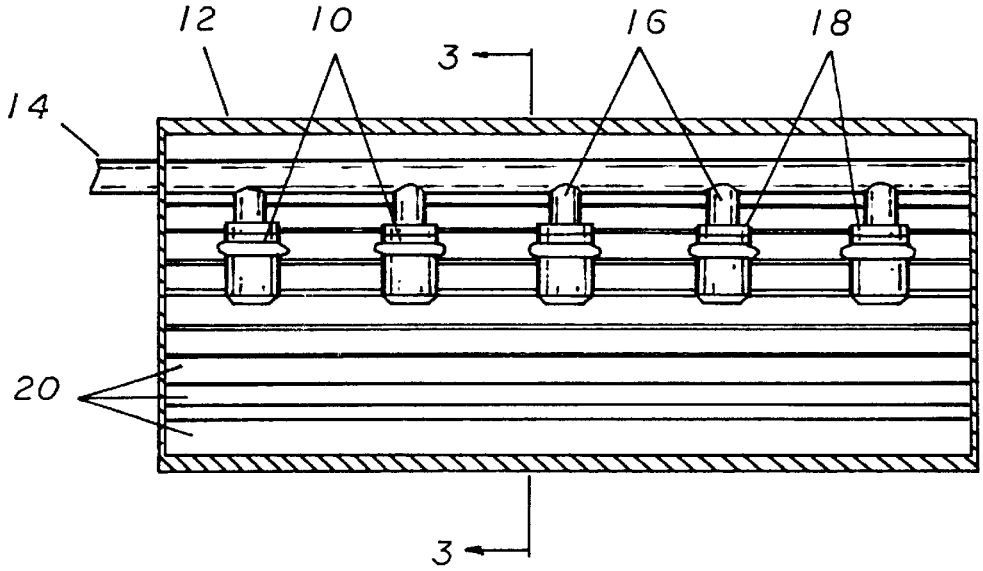
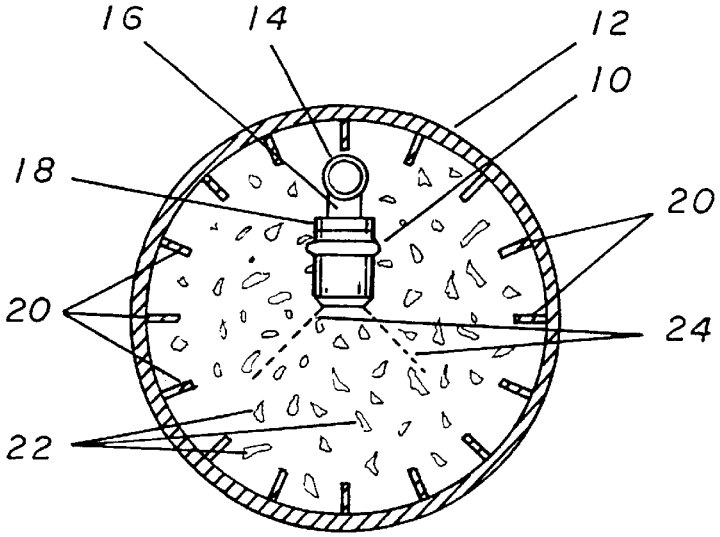
FIG 2

FIG 3
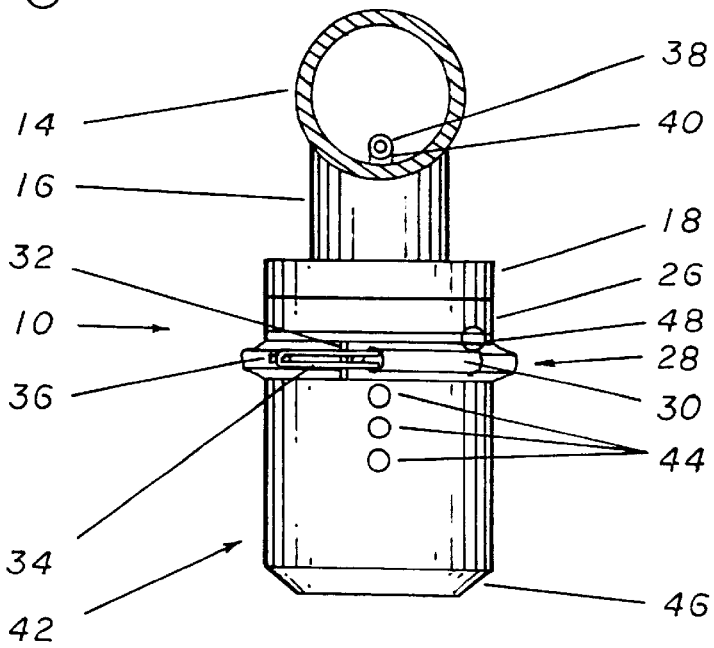
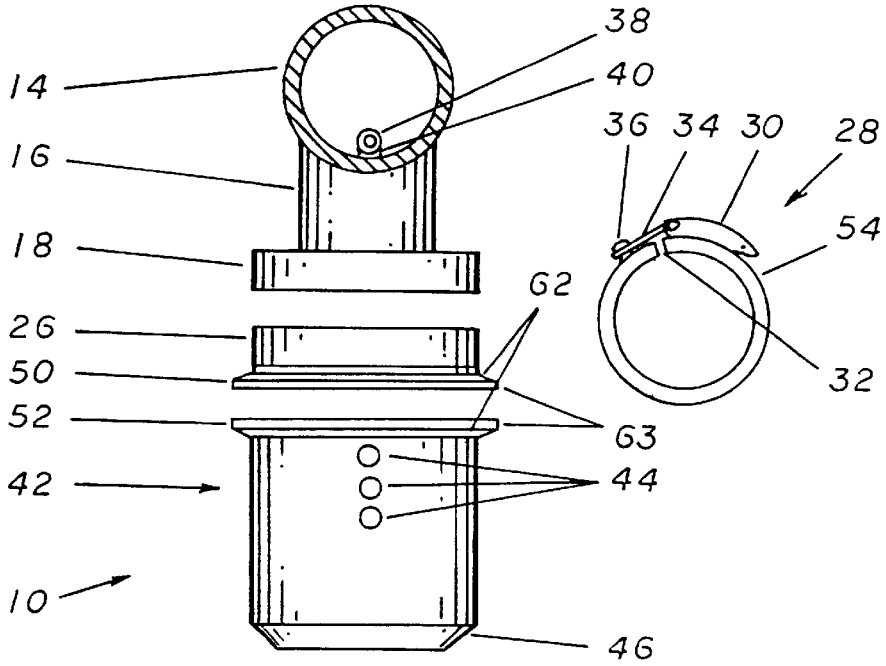
FIG 4

FIG 5
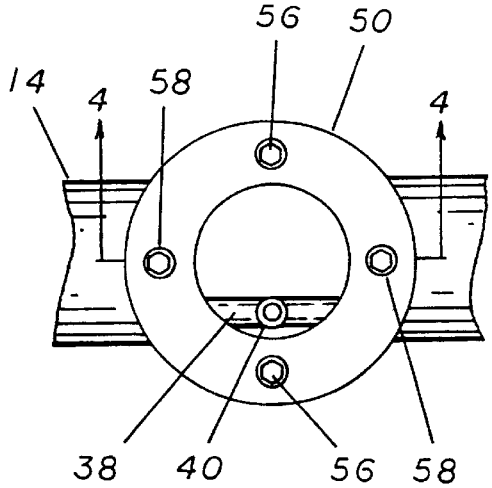
FIG 6
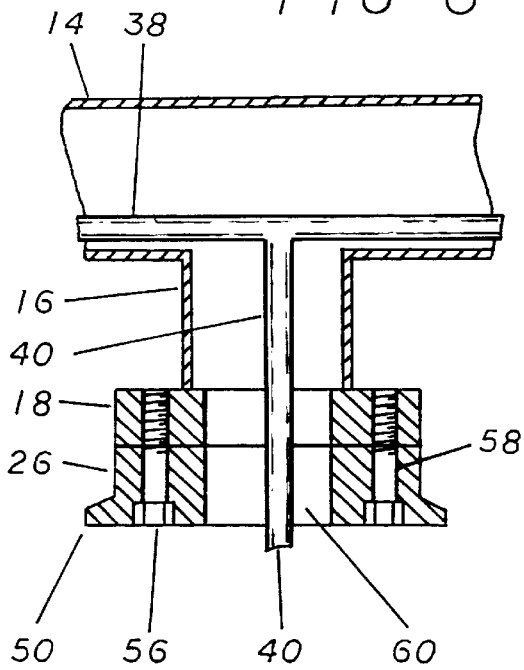
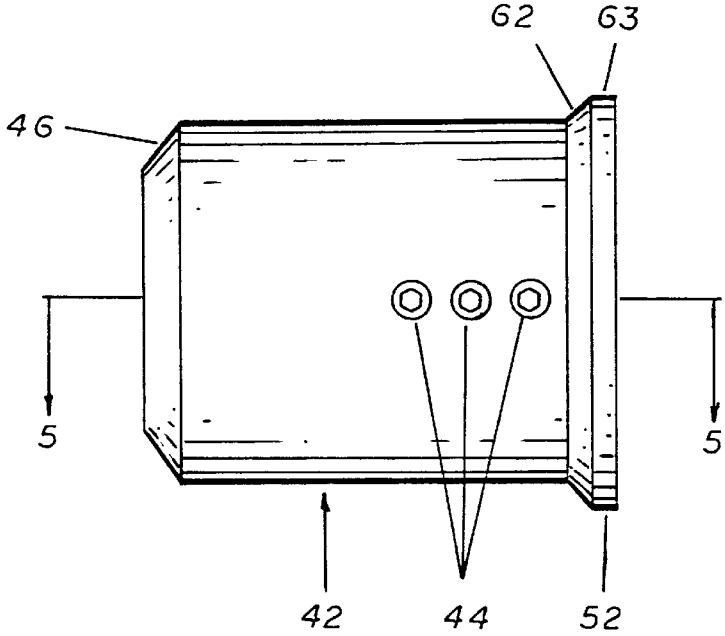
FIG 7

FIG 8
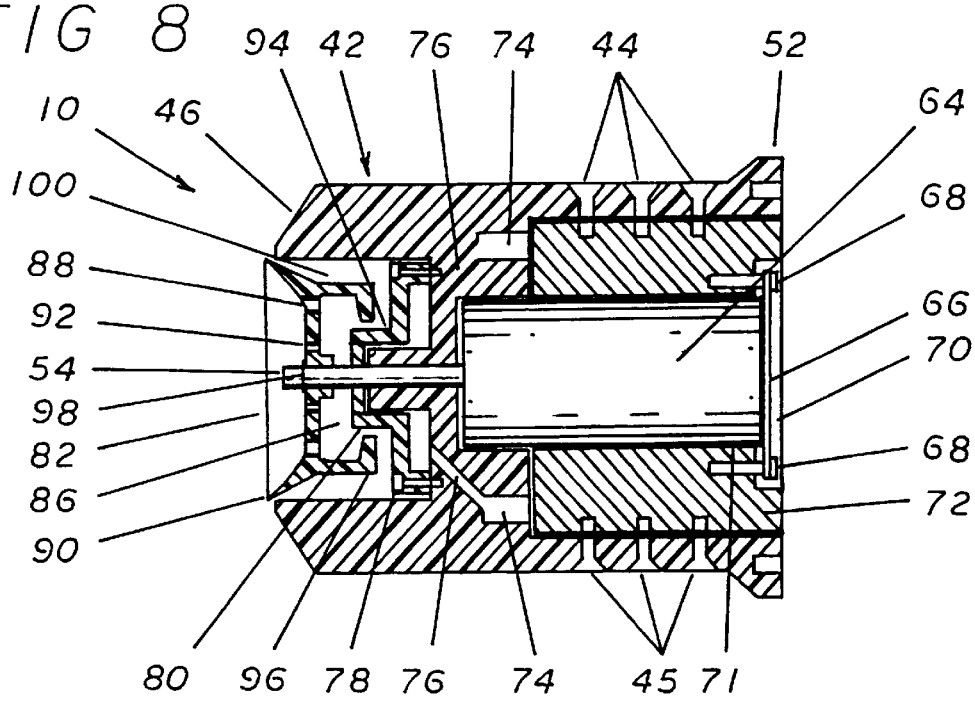
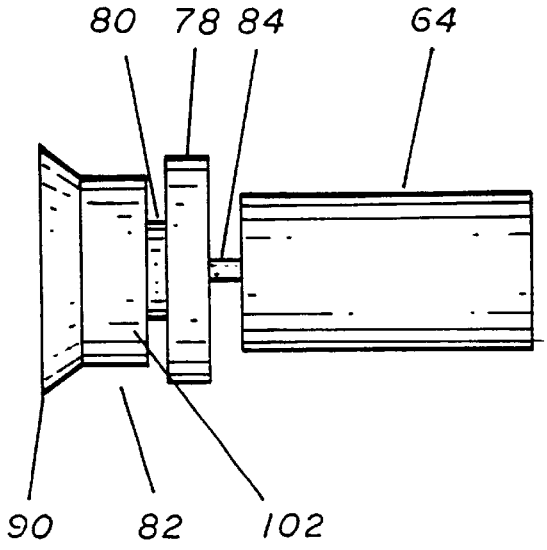
FIG 9

SPINNING DISC RESIN ATOMIZER

BACKGROUND OF THE INVENTION

The present invention relates to an improvement in the methods used to apply resin to raw materials such as wood chips used in the manufacture of construction material such as oriented strand board (OSB). More specifically, to a mechanism that applies the liquid resin that is less susceptible to the common problems of excessive wear and clogging that are associated with such resin application devices and also which are mounted within an application assembly in a manner that allows for their easy removal and replacement in the case of necessary maintenance.

In the construction industry today it is very common to use composite materials in the manufacture of such things as housing and other types of buildings where they are used most commonly as outer sheathing in place of more expensive materials like plywood. In the manufacture of these composite products, a large number of small particles of raw material is fed into a rotating drum where they are suspended within its interior. Additionally, the interior of the drum contains a plurality of resin atomizer units which disperse a fine fog of atomized resin into the interior of the drum. This resin fog entirely coats the exterior surface of the individual pieces of raw material so that they may be bound together in a specific form in a later manufacturing process upon being removed from the drum.

While this process produces quality OSB and other similar products, there are a number of problems specifically associated with the resin atomizer units that are commonly encountered during the manufacturing process. The first of these is that the resin, by its nature, has high adhesion properties which causes it to stick to the interior surfaces of the atomizer unit. One solution to this problem was offered in U.S. Pat. No. 5,914,153 issued to Swink et al. which provided a method of introducing a solvent into the atomized unit at specific time intervals during operation. While this system does reduce the adhesion problems, it does not entirely eliminate them partially due to the fact that the current atomizer units are constructed of aluminum or other metallic alloy to which the resin easily bonds. Additionally, the most commonly used resin in the industry is phenol-formaldehyde which has a very high alkaline content and is very corrosive and tends to corrode the critical components of the atomizer unit. These two factors create a situation in which the resin coating drums must periodically shutdown for cleaning and/or parts inspection or replacement. This is obviously an undesirable condition as it tends to increase downtime to the production line which lessens profits.

Another problem in the prior art is the manner used to attach the atomizer units in the proper location within the drum. The method commonly employed to attach the resin atomizer to the header pipe within the rotating drum is to use a plurality of bolts to secure it to a mounting plate extending from the header pipe. While this provides a secure method of resin atomizer attachment, it makes servicing the units troublesome and time consuming as a technician must at times extend himself into the drum to gain access to the mounting bolts. This makes the servicing procedure cumbersome at best and can add to the overall downtime of the production line, not to mention the unnecessary addition of difficulty and danger to the person actually performing the servicing operations.

From the forgoing discussion it can be seen that it would be desirable to provide a mechanism by which the raw materials for the manufacture of composite construction materials such as OSB can be effectively coated with adhesion resin in a manner that would reduce the production line down time associated with the necessary cleaning and maintenance required by today's resin atomizers and extend the useable life of their critical components. Additionally, it can be seen that it would be advantageous to provide a means by which the resin atomizers could be easily removed and reinstalled to their point of attachment within the rotating drum to facilitate easy maintenance. These improvements in the design of resin atomizers would lead to greater efficiencies in the production of construction materials such as OSB which would in turn lead to better products and improved operator profits.

SUMMARY OF THE INVENTION

It is the primary objective of the present invention to provide a method of constructing resin atomizers that would decrease the tendency of the resin to adhere to the surfaces of the operational components of the atomizer and also limit the resin's tendency to erode the critical resin passageways of the resin cone and housing.

It is an additional objective of the present invention to provide such a method of constructing resin atomizers in a manner that would facilitate their easy removal and reinstallation from their point of attachment within the rotating drum used to coat the raw materials prior to their final assembly into OSB sheathing.

It is a further objective of the present invention to provide such a method of constructing resin atomizers of a material that not only resists the adhesion and wear problems associated with the applications of such resins, but also is of a light weight which enhances a technician's ability to handle and manipulate them during maintenance.

These objectives are accomplished by constructing a resin atomizer unit from a variety of ultra high molecular weight (UHMW) plastics. The use of these materials benefits in the construction of a resin atomizer both in its natural resistance to the adhesive qualities of the resin and in its relatively low weight when compared to the metallic alloys that were previously used in their construction.

The construction of OSB and other similar composite building materials is accomplished by introducing a large amount of small individual pieces of a raw material such as non-uniformly sized wood chips into a large rotating drum. The interior of the drum is lined with a plurality of inwardly extending fins which protrude uniformly a short distance from their point of attachment to the interior wall of the drum. The purpose of the fins is to agitate the pieces of raw material contained within the drum so that they are constantly tumbling through its center. With the wood chips so suspended and tumbling in this manner, the resin atomizer can evenly apply the adhesive resin to the exterior of the chips without the chips having to contact the surface of the application device. Once the application process has been completed, the wood chips are removed from the drum and processed into their final configuration.

The interior of the rotating drum also contains the header pipe which enters it from one end and which serves two purposes for the operation of the drum. The first of these is to provide a point of attachment for the plurality of resin atomizers contained within the drum. The second purpose of the header pipe is to provide a protected conduit through which the resin and other necessary chemicals or solvents can be piped to supply the resin atomizers during the operation of the resin coating operation in the production of OSB.

The plurality of resin atomizers are attached to the header pipe by the use of an equal plurality of attachment pipes which extend from the header pipe into the interior of the rotating drum. The inward edge of the attachment pipes are fitted with ring-shaped mounting flanges that contain an inner passageway and are machined in a manner so that their outer edges match the outside diameter of the atomizer units. Additionally, the mounting flanges are equipped with a plurality of bolt mounting holes which provide a mechanism by which the atomizer mount can be securely attached.

The mounting of the atomizer unit within the rotating drum is accomplished by separately bolting the atomizer mount flange to the pipe mount flange. The lower edge of the atomizer mount flange is equipped with a raised mount ring shoulder which matches in form and diameter to the body ring shoulder on the upper edge of the atomizer body. When these two components are fitted together, their connection is facilitated by the use of the ring clamp which encircles this connection and firmly holds the atomizer body to the atomizer mount flange. Additionally, the ring clamp is equipped with a release handle which provides a means by which it can be opened up and removed to quickly and easily remove and reinstall the atomizer body during maintenance or repair.

The resin atomizer unit is primarily comprised of an exterior atomizer body which is cylindrical in shape with a hollow interior. The interior houses an electric motor which is attached via a drive shaft to the resin cone at the most forward end of the atomizer body. The interior of the atomizer body is also equipped with a series of passages and components which are designed to channel the resin pumped into it to the resin well built into the back of the resin cone. The resin is supplied to the present invention by the resin feeder line coming from the interior of the header pipe and is passed through the resin plate located between the electric motor and resin cone. The purpose of the resin plate is to direct the flow of resin into the resin well in the back of the resin cone so that it can be properly distributed by the action of the resin cone.

The purpose of the electric motor is to spin the resin cone at a very high rate of speed. The spinning of the resin cone forces the resin contained within the resin well out of a plurality of small orifices that surround the outer edge of the central cone disc and into the cavity formed by the cone lip which extends around and forms the most forward edge of the resin cone. This method of resin delivery breaks it down into a very fine cloud of resin droplets which is the optimal consistency to properly coat the raw material contained within the rotating drum. Additionally, the most forward edge of the atomizer body has a beveled surface that is angled diagonally away and down from the center of the atomizer body. The angle created by this bevel is such that the air flow around it tends to carry the resin droplets away from the atomizer body which helps to limit the build up of hardened resin on the outer surface of the resin atomizer body. This is important to the operation of the present invention as the build up of resin on the operational surfaces tends to limit its efficiency.

The atomizer body and resin plate of the present invention are constructed of ULTRA HIGH MOLECULAR WEIGHT plastic, commonly and hereinafter referred to as UHMW, which has a number of properties that are beneficial for use in these types of applications. The first of these is that it is naturally resistant to the adhesive properties of the resins that are used in the manufacturing process of OSB. This property of UHMW plastic means that the components of the present invention that are constructed of UHMW will be less susceptible to the clogging and fowling problems associated with the use of metallic alloys or other similar materials. Another beneficial property of the UHMW plastic for use in this application is that it is also naturally resistant to the corrosive nature of the resins that are used. With other materials, the resin passing through the resin dispersion holes tends to bore the holes out in a relatively short period of time which affects the balance of the resin cone which can impart a wobbling motion to it and destroy the associated bearings in a short period of time. The use of the corrosive resistant UHMW plastic extends the life of these components which reduces downtime of the production line that was due to the constant need for replacing these parts. Finally, the components made from the UHMW plastic are much lighter than those constructed from metallic alloys which makes the present invention easier to work with during required maintenance procedures.

The resin cone component of the present invention is machined from Acetal which is also known as polyacetal, polyoxymethylene, or polyformaldehyde, which is a high performance engineering polymer. The use of this material to produce the resin cone provides a component that is more resistant to both the corrosive and adhesive properties of the resin than the previously used metallic alloys. Additionally, the resin cone component of the present invention is also significantly lighter than those of the prior art and therefore places less stress on its electric motor which in turn leads to a longer life span for the motor and bearings. Finally, the use of these materials allows the components of the present invention to be manufactured with thinner walls which creates larger clearances and passages for the resin to flow in critical areas which helps reduce the incidents of resin build up and clogging, therefore reducing production downtime.

Therefore, the present invention provides a method of constructing the spinning disc resin atomizers used in the manufacture of OSB which greatly reduces the resin's tendency to adhere to the critical surfaces of the atomizer during operations. This reduction of resin adhesion improves the performance of such system as it increases the atomizer's efficiency and reduces downtime associated with require cleaning. Additionally, the present invention can also be equipped with a solvent application device that can further reduce the resin's tendency to adhere which further extends the invention's productivity. The materials used in the construction of the present invention also have the beneficial quality of resisting the abrasive nature of the resin which lessens the need for periodic component replacement and leads to further increases in productivity in much the same manner as described above. Another benefit of the use of the materials herein described is the construction of the present invention also lessens its overall weight which makes any maintenance that may be required much easier. Finally, the quick release method of attaching the individual resin atomizers to the header pipe within the rotating drum also enhances the ease by which the invention can be serviced and thereby leads to greater efficiencies in the production of OSB.

For a better understanding of the present invention reference should be made to the drawings and the description in which there are illustrated and described preferred embodiments of the present invention.

DESCRIPTION OF THE DRAWINGS

FIG. 1 is a side elevation cut-away view of a rotating resin application drum containing a plurality of the present invention and which illustrates their manner of placement within the drum.

FIG. 2 is a front elevation view of the rotating resin application drum of FIG. 1 taken along line 3 which illustrates the manner in which the present invention projects resin to coat the raw material contained within the drum.

FIG. 3 is a side elevation view of the present invention illustrating the manner employed to attach it the header pipe within the rotating drum.

FIG. 4 is a side elevation exploded view of the present invention of FIG. 3 illustrating the manner of construction of the components employed to make the described connection to the header pipe.

FIG. 5 is a bottom elevation view of the component of the present invention used to attach it to the header pipe illustrating the mechanism employed to facilitate the instant attachment.

FIG. 6 is a side elevation cut-away view of the attachment apparatus of FIG. 5 taken along line 4 and further detailing the mechanism of the attachment.

FIG. 7 is a side elevation view of the atomizer body component of the present invention illustrating the orientation of its major components.

FIG. 8 is side elevation cut-away view of atomizer body of FIG. 7 taken along line 5 and illustrating the orientation of the present invention's major components contained within the atomizer body.

FIG. 9 is a side elevation view of the resin cone, resin plate, and electric motor components of the present invention illustrating their orientation in respect to one another absent the remaining components.

DESCRIPTION OF THE PREFERRED EMBODIMENT

Figure 10:
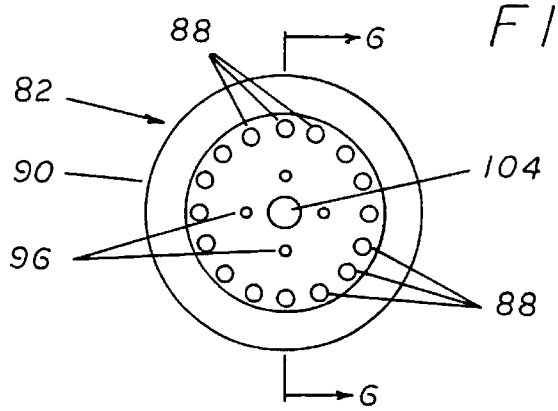
FIG. 10 is a front elevation view of the resin cone component of the present invention illustrating its manner of construction and the orientation of its plurality of resin dispersion holes.
Figure 11:
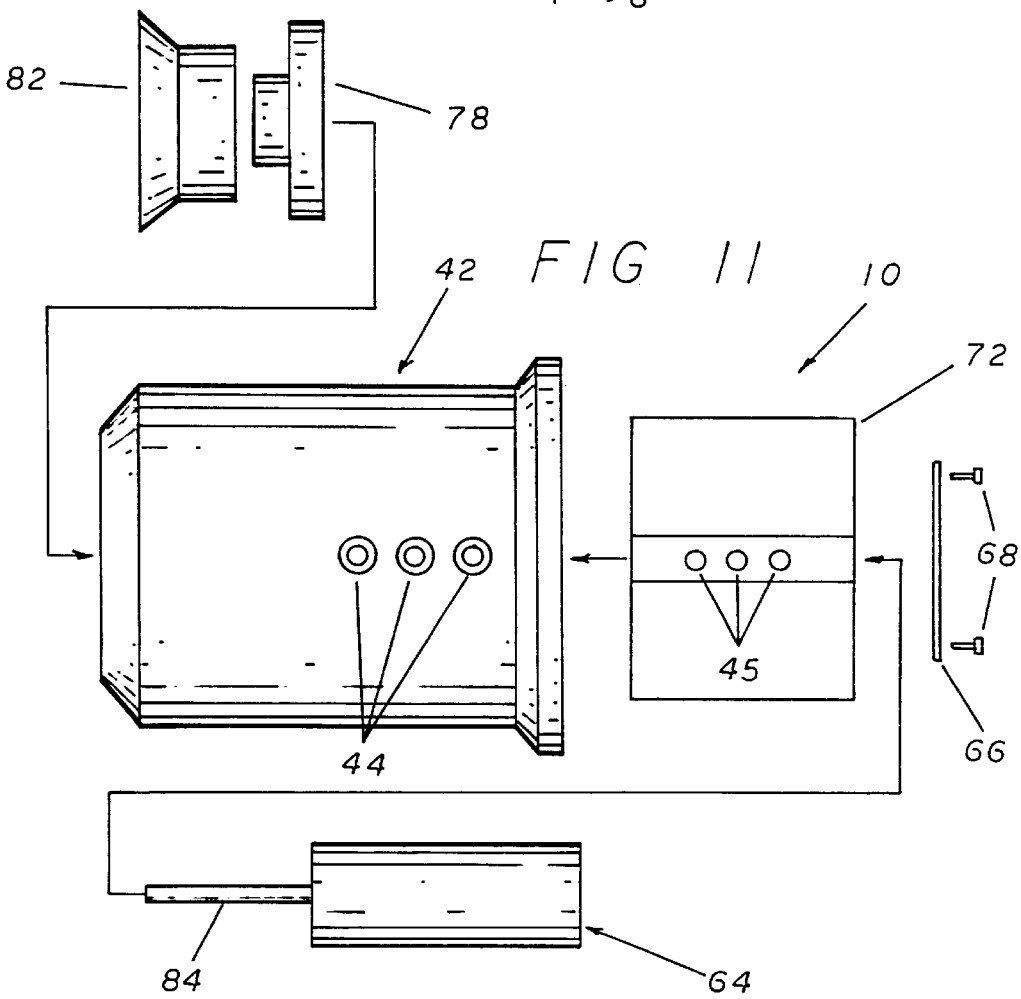
FIG. 11 is a side elevation exploded view of the atomizer body component of the present invention illustrating the individual components contained therein and the sequence by which they are installed within the resin body.

Referring now to the drawings, and more specifically to FIGS. 1 and 2, the resin atomizer 10 is a self contained unit contained within a relatively large rotating resin application drum 12. The rotating resin application drum 12 contains a plurality of inwardly extending fins 20 fitted to its inner surface and which protrude slightly into its interior. The purpose of the fins 20 in part is to agitate the contained wood chips 22 so that they are prone to tumble around the center of the application drum 12 where they can be coated with the resin fog 24. Additionally, the fins 20 also carry wood chips 22 that accumulate along the outer circumference of the rotating resin application drum 12 to a point at its upper edge where they fall back through the center of the interior.

In the center of the rotating resin application drum 12 the wood chips 22 pass through a resin fog 24 projected by the plurality of the present invention units contained therein. This process coats the entire outer surface of the wood chips 22 evenly so that they can be pressed together to form the building materials that are the end result of this manufacturing process.

The positioning of the resin atomizer 10 is accomplished by the use of the header pipe 14. The header pipe 14 is a tubular apparatus that extends from one end of the rotating resin application drum 12 to the other through its interior and in a relative location so that the position of resin atomizers 10 are correct for the proper distribution of the resin fog 24. Additionally, the header pipe is stationary relative to the motion of the rotating resin application drum 12 which results in a mechanism by which the plurality of resin atomizers 10 can be mounted within the interior of the rotating resin application drum 12 in the manner and location so that they can most efficiently distribute the resin fog 24 over the suspended wood chips 22.

The attachment of the resin atomizers 10 is accomplished through the use of a plurality of pipe mounts 16 which are short sections of pipe that are attached to and extend inwardly from the lower surface of the header pipe 14. The outward most ends of the pipe mounts 16 are equipped with an equal number of pipe mount flanges 18 which provide the surface to which the resin atomizers 10 are attached. This attachment is accomplished through the use of a plurality of threaded bolts or other similar devices that secure a component of the resin atomizer 10 to the pipe mount flange 18; a procedure that will be discussed in greater detail below.

The nature of the connection between the pipe mount 16 and the present invention is further detailed in FIGS. 5 and 6. The pipe mount flange 18 is positioned in the proper location beneath the header pipe 14 by the use of the pipe mount 16 which extends from its point of attachment at the header pipe 14 down into the center of the interior of the rotating resin application drum 12. The pipe mount flange 18 is a ring-like component permanently attached at its upper surface to the lower surface of the pipe mount 16 and having a flat machined lower surface configured to mate with the upper surface of the atomized mount flange 26. This attachment is facilitated by the use of a plurality of mount bolts 56 which are threaded through an equal number of mount bolt holes 58 extending through the atomizer mount flange 26 and into the pipe mount flange 18. The atomizer mount flange 26 is the only component of the present invention that is so fixedly attached to the header pipe 14 and also provides the mechanism by which the remaining components of the resin atomizer 10 can be quickly and easily removed from the interior of the rotating resin application drum 12 for cleaning or maintenance.

The construction of the pipe mount flange 18 and the atomizer mount flange 26 also provides a central hole 60 which allows for the passage of supply lines that may be contained within the header pipe 14 to the present invention. This is important to the operation of the present invention as it needs a steady supply of resin, motor cooling air, and possibly other materials such as cleaning solvents during the manufacturing process. Also, it is beneficial to the operation to protect these supply lines to limit their exposure to the conditions present in the interior of the rotating resin application drum 12. Thus, the interior of the header pipe 14 contains the resin supply line 38 which extends down its entire length. Additionally, at the junction of the header pipe 14 and the pipe mount 16, a resin feeder tube 40 is taken off from the resin supply line 38 and passes through the pipe mount 16 and the central hole 60 in the pipe mount flange 18 and the atomizer mount flange 26. The resin feeder tube 40 is then attached to the relative internal components of the present invention and therefore is capable of providing an adequate amount of resin to the present invention during the manufacturing process.

The manner in which the atomizer body 42 is connected to the atomizer mount flange 26, and therefore the header pipe 14 and its related components, is further detailed in FIGS. 3 and 4. As previously stated, this connection is pivotal to the operation of the present invention as it allows the atomizer body 42 to be quickly and easily removed and replaced in the event of necessary maintenance. The critical components of the present invention in this respect are the mount ring shoulder 50 located on the lowest edge of the pipe mount flange 18 and the body ring shoulder 52 located at the upper most edge of the atomizer body 42. The mount ring and body ring shoulders, 50 and 52, are each composed of a diagonally oriented shoulder bevel 62 which extend outwardly from the outer most surfaces of the atomizer mount flange 26 and the atomizer body 42 respectively but with each shoulder bevel 62 oriented in an opposite direction. Additionally, each shoulder bevel 62 terminates with the shoulder face 63 at the exact same distance from their point of origin in a planer surface that is of the same orientation to the outer surfaces of the atomizer mount flange 26 and the atomizer body 42.

When the upper surface of the atomizer body 42 is mated with the lower surface of the atomizer mount flange 26, the mount ring shoulder 50 and the atomizer ring shoulder 52 form a raised triangular shaped in cross-section ring around the joint between the atomizer mount flange 26 and the atomizer body 42. This configuration is then exploited to attach the two together in a manner that allows them to be detached and reattached quickly and easily.

This attachment is facilitated by the use of the ring clamp 28 which is a ring-like apparatus having a expansion gap 32 forming a break in its ring body 54. The expansion gap 32 allows the ring body 54 to be opened and closed which in turn provides a mechanism by which the ring clamp 28 can be both expanded to fit over the mount ring and atomizer ring shoulders, 50 and 52, and contracted to bind these two elements of the present invention together. To further facilitate this function, the internal surface of the ring clamp 28 is constructed to mirror the outer surfaces of the mount ring and atomizer ring shoulders, 50 and 52. Therefore, the ring clamp 28 accomplishes the attachment of the atomizer body 42 to the atomizer mount flange 26 and thus, to the header pipe 14 and its related components.

The components of the ring clamp 28 that facilitate its expansion and contraction function are all related to and oriented around the expansion gap 32. The outer surface of the ring clamp 28 on one side of the expansion gap 32 is equipped with a clamp hook 36 which extends above the surface of the ring body 54 which contains an indentation in its upper surface that is oriented away from the expansion gap 32. Additionally, the opposite side of the surface of the ring body 54 is equipped with a pivotally mounted clamp handle 30 having the pivotal mount at its edge that is closest to the expansion gap 32. This end of the clamp handle 30 also provides the point of pivotal attachment for the clamp U-bolt 34 which extends across the expansion gap 32 where its closed end can engage the clamp hook 36. The connection between the clamp handle 30 and the clamp U-bolt 34 is constructed in a manner so that the lifting of the outer end of the clamp handle 30 moves the closed end of the clamp U-bolt 34 farther away from the expansion gap 32 which allows the ring clamp 28 to be opened up for installation and removal from the mount ring and atomizer ring shoulders, 50 and 52. Conversely, when the outer end of the clamp handle 30 is forced back down to the surface of the ring body 54, the closed end of the clamp U-bolt 34 is pulled back towards the expansion gap 32 which closes the ring clamp 28 around the mount ring and atomizer ring shoulders, 50 and 52, which in turn securely binds the atomizer body 42 to the atomizer mount flange 26. Also, the clamp handle 30 is equipped at its outer end with a lock pin 48 which is employed to prevent the unwanted opening of the expansion gap 32 and ring body 54 during the manufacturing process.

The manner of construction of the atomizer body 42 and its related internal components is further detailed in FIGS. 7, 8, 9, and 11. The atomizer body 42 is the component of the present invention that contains all of the critical components for the delivery of resin during the manufacture of OSB. With this in mind, the atomizer body 42 is a largely hollow cylindrical object that is cast or machined from UHMW plastic. The rear edge of this cylinder is equipped with the atomizer ring shoulder 52 employed as previously described in the attachment of the atomizer body 42 to the atomizer mount flange 26. The forward edge of the atomizer body 42 is equipped with an inwardly beveled edge called the atomizer bevel 46. The atomizer bevel 46 is located on the end of the atomizer body 42 from which the resin is projected during its operation and is a feature of the present invention which aids in its overall ability to resist the adhesive nature of the resin employed in the intended process. This characteristic is due to the angle of the atomizer bevel 46 in relation to the atomizer body 42 as it is built at an angle that has been found to minimize the tendency of the present air currents created by the spinning of the resin cone 82 (to be discussed in greater detail below) to form eddies, or pockets of relatively calm air which facilitate the formation of resin build up on neighboring surfaces.

The interior of the atomizer body 42 is divided into a plurality of cavities and passageways that contain the operational components of the invention and direct the flow of the resin to the proper locations. The first of these is the hub well 70 which is located at the rear of the atomizer body 42 and provides the point of attachment for the hub 72 and electric drive motor 64. The hub 72 is the only component of the present invention that is manufactured from aluminum or related metallic alloy and which serves the purpose of providing a solid point of attachment for the electric drive motor 64. In the assembly of the present invention, the hub 72 is fitted within the hub well 70 where its exterior walls fit against the interior walls of the hub well 70. The hub 72 is then held there in place by the use of a plurality of hub anchor bolts 44 which pass through the atomizer body 42 in a plurality of locations by means of the hub bolt holes 45 and are then threaded into the body of the hub 72. This provides a method of attaching the hub 72 to the atomizer body 42 which ensures that it will fulfill its primary purpose of anchoring the electric drive motor 64 securely within the body of the present invention.

The hub 72 also contains a hollowed out central motor well 71 which provides the attachment point for the electric drive motor 64. This attachment is accomplished by placing the electric drive motor 64 inside of the motor well 71 in a manner so the motor shaft 84 extends through the atomizer body 42 to a point just rearward of its forward most edge. The electric drive motor 64 is contained within the motor well 71 by the use of the motor retainer bracket 66 which spans the rear opening of the motor well 71 in a manner so that it bisects the circumference of the electric drive motor 64 and it is held in that position by the use of the retainer mount bolts 68 which pass through the motor retainer bracket 66 and are threaded into the body of the hub 72. This mechanism, once in place, keeps the electric drive motor 64 from backing out of its position within the motor well 71 and because of the closed off configuration at the front of the hub well 70, the electric drive motor 64 is contained within the hub 72. This method of attachment secures the electric drive motor 64 within the body of the invention even at the extremely high revolutions per minute required in its operation and also provides a mechanism by which it can be easily removed in the event that some maintenance is required.

The motor shaft 84 extends through the closed off interior of the atomizer body 42 at the shaft collar 94 which extends partially into the cone well 100 located at the forward end of the present invention. Additionally, the motor shaft 84 passes through the resin plate 78 which is attached to the rear most surface of the cone well 100. Finally, the most forward end of the motor shaft 84 provides the point of attachment for the resin cone 82 by use of the cone retainer nut 98 and is the only component of the invention that is rotationally driven by the electric drive motor 64.

Forward of the hub 72, the interior of the atomizer body 42 is closed off to form the forward wall of the hub well 70. From this forward portion of the atomizer body 42, the resin ports 74 extend forward and may be connected to the resin feeder tube 40 as previously described. The resin ports 74 channel the resin from the resin feeder tube 40 into the resin channels 76 which in turn direct the resin into the rearward most portion of the cone well 100. From this point the resin is drawn between the outer surface of the shaft collar 94 and the inner surface of the plate collar 80. The purpose of the resin plate 78 and its attached component the plate collar 80 is to direct the flow of resin into resin well 86 which is a cavity formed in the rear of the resin cone 82.

Figure 12:
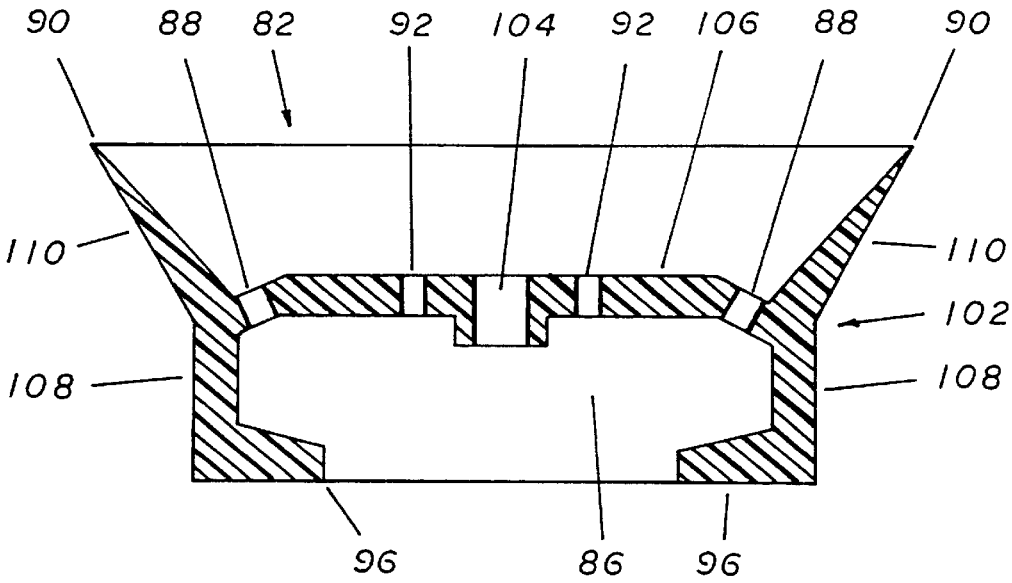
FIG. 12 is a side elevation cut-away view of the resin cone of FIG. 10 taken along line 6 and illustrating its manner of construction.

As described above, the resin cone 82 is the component of the present invention which is rotationally driven by the electric drive motor 64. It is this rotational motion of the resin cone 82 which atomizes the resin and converts it into the resin fog 24 and it is also the component which disperses the resin fog 24 in the desired location. The method of construction and the orientation of the major components of the resin cone 82 are further illustrated in FIGS. 10 and 12. The resin cone 82 is primarily a relatively short cylindrical object composed of a cone body 102 with the dispersion flange 110 located at its most forward end and the cone flange 108 located in its rearward end. The cone flange 108 comprises the cylindrical portion of the cone body 102 and contains a hollow central portion forming a resin well 86. The resin well 86 forms a reservoir which contains the resin in the proper place just prior to its distribution through the dispersion flange 110. The resin well 86 is defined on its outer edges by the interior of the walls of the cone flange 108, on its forward edge by the cone disc 106 (which separates the interiors of he cone flange 108 and the dispersion flange 110), and on its rearward edge by the resin well lips 96. The resin well lips 96 extend inwards from the inner wall of the cone flange 108 to terminate just short of the outer surface of the plate collar 80 of the resin plate 78. This configuration provides enough space so that the resin may pass between them to enter the resin well 86.

The cone disc 106 not only serves as a forward barrier to the resin well 86, but also provides the mechanism by which the resin is atomized and dispersed out the forward end of the dispersion flange 110. The dispersion mechanism is facilitated by the inclusion of a plurality of resin dispersion holes 88 located on the very outer edge of the cone disc 106 and which pass through it from the resin well 86 to the interior of the dispersion flange 110. With a quantity of resin contained within the resin well 86, the centrifugal force imparted by the rotational motion of the electric drive motor 64 to the resin cone 82 forces the resin through the resin dispersion holes 88 at such a high rate of speed that it breaks up the liquid resin to such a degree that it forms the resin fog 24 used to coat the raw material. Additionally, the cone disc 106 is also equipped with a centrally located motor shaft hole 104 which provides a point of attachment for the motor shaft 84 which is surrounded by a plurality of air holes 92. The air holes 92 allow a controlled amount of air to be drawn into the resin well 86 which has been found to improve the atomization process during the operation of the present invention.

Once the resin has passed through the resin dispersion holes 88, the centrifugal force of the spinning resin cone 82 forces the resin fog 24 to follow the diagonally outwardly oriented interior walls of the dispersion flange 110. The resin fog 24 follows this wall until it reaches the cone lips 90 the knife edge of which breaks down the resin further to form the resin fog 24 which is then dispersed beyond the most forward surface of the present invention. Finally, the angle of the interior walls of the dispersion flange 110 controls the angle at which the resin fog 24 is projected and so also controls the area of effective coverage of the resin fog 24.

Figure 13:
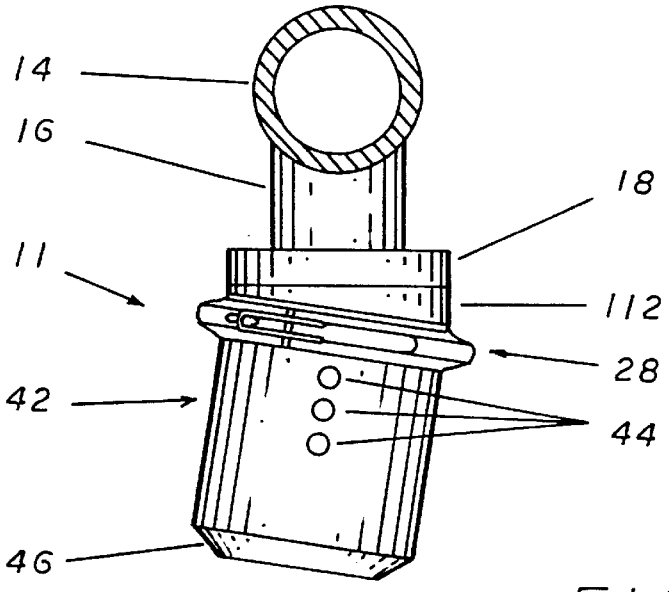
FIG. 13 is a side elevation view of an alternative embodiment of the present invention which employs a beveled atomizer mount plate to vary the angle of resin delivery within the rotation drum.

An alternative embodiment of the present invention is shown in FIG. 13 and which illustrates an angled resin atomizer 11 in which the atomizer body 42 is attached to the header pipe 14 and its related components in a manner so that it is offset at an angle in comparison to that of the previous embodiment. This angled attachment is accomplished by replacing the atomizer mount flange 26 with a beveled atomizer mount flange 112. The beveled atomizer mount flange 112 is constructed in a manner so that it is narrower on one side in the cross section than it is on the other. This configuration results in a atomizer body 42 that is diagonally oriented away from the centerline of the header pipe 14 and pipe mount 16. The angled resin atomizer 11 results in a resin fog 24 pattern that has been found to be beneficial under certain operating conditions as it can vary the efficiency of the raw material coating process. Finally, in all other aspects of the operation and installment of the atomizer body 42, the angled resin atomizer 11 is substantially identical to the procedures described for the previous embodiment.

Although the present invention has been described in considerable detail with reference to certain preferred versions thereof, other versions are possible. Therefore, the spirit and scope of the appended claims should not be limited to the description of the preferred versions contained herein.

What is claimed is:

1. A spinning disc resin atomizer comprising:

a spinning resin cone body made from an ultra high molecular weight plastic;

said spinning cone body having an upper cone flange about a center cone disc so as to form a resin well;

said cone disc having a first diameter and forming a plurality of resin dispersion holes about the outer portion of said cone disc and a plurality of inner air holes about the inner portion of said cone disc; and said spinning resin cone further having a lower dispersion flange having a diameter greater than the diameter of said cone disc.

2. A spinning disc resin atomizer as in claim 1 wherein said outer portion of said cone disc angles upward toward said resin well.

3. A spinning disc resin atomizer as in claim 2 further comprising an atomizer body made from an ultra high molecular weight plastic said body having an open lower portion for said spinning resin cone and the upper portion forming a hub well.

4. A spinning disc resin atomizer as in claim 3 further comprising a metallic motor hub fixedly mounted in said hub well.

5. A spinning disc resin atomizer as in claim 4 further comprising an raised atomizer ring portion about the upper outside edge of said atomizer body.

6. A spinning disc resin atomizer as in claim 5 further comprising a ring clamp for attachment use about said raised atomizer ring.

7. A spinning disc resin atomizer as in claim 6 further comprising a beveled atomizer mount flange for mating with said raised atomizer ring portion and for removable attachment with said ring clamp.

8. A spinning disc resin atomizer for use in the application of resin to various materials said atomizer comprising:

an atomizer body made from an ultra high molecular weight plastic;

said body having an open lower portion an open upper portion forming a hub well;

a raised atomizer ring shoulder about said upper portion of said atomizer body; and a ring clamp for attachment about said raised atomizer ring shoulder.

9. A spinning disc resin atomizer as in claim 8 further comprising a metallic motor hub fixedly mounted in said hub well.

10. A spinning disc resin atomizer as in claim 9 further comprising:

a spinning resin cone body made from an ultra high molecular weight plastic;

said spinning cone body having an upper cone flange about a center cone disc so as to form a resin well;

said cone disc having a first diameter and forming a plurality of resin dispersion holes about the outer portion of said cone disc and a plurality of inner air holes about the inner portion of said cone disc; and said spinning resin cone further having a lower dispersion flange having a diameter greater than the diameter of said cone disc.

11. A spinning disc resin atomizer as in claim 10 wherein said outer portion of said cone disc angles upward toward said resin well.

12. A spinning disc resin atomizer as in claim 11 further comprising a beveled atomizer mount flange for mating with said raised atomizer ring portion and for removable attachment with said ring clamp.

13. A spinning disc atomizer for use in atomizing liquids said atomizer comprising:

a spinning cone body made from an ultra high molecular weight plastic;

an atomizer body made from an ultra high molecular weight plastic;

said atomizer body having an open lower portion an open upper portion forming a hub well;

a raised atomizer ring shoulder about said upper portion of said atomizer body; and a a metallic motor hub fixedly mounted in said hub well.

14. A spinning disc atomizer as in claim 13 wherein said spinning cone body has an upper cone flange about a center cone disc so as to form a well;

said cone disc has a first diameter and forms a plurality of resin dispersion holes about the outer portion of said cone disc and a plurality of inner air holes about the inner portion of said cone disc; and said spinning cone further has a lower dispersion flange having a diameter greater than the diameter of said cone disc.

15. A spinning disc atomizer as in claim 14 wherein said outer portion of said cone disc angles upward toward said well.

16. A spinning disc atomizer as in claim 15 further comprising a ring clamp for attachment about said raised atomizer ring shoulder.

17. A spinning disc atomizer as in claim 16 further comprising a beveled atomizer mount flange for mating with said raised atomizer ring portion and for removable attachment with said ring clamp.

* * * * *